US009303373B1

(12) United States Patent
Walker et al.

(10) Patent No.: US 9,303,373 B1
(45) Date of Patent: Apr. 5, 2016

(54) COLLAPSIBLE PYLON

(71) Applicants: Diannia Walker, Sacramento, CA (US); Falme A. Lampkins, Sacramento, CA (US)

(72) Inventors: Diannia Walker, Sacramento, CA (US); Falme A. Lampkins, Sacramento, CA (US)

( * ) Notice: Subject to any disclaimer, the term of this patent is extended or adjusted under 35 U.S.C. 154(b) by 0 days.

(21) Appl. No.: 14/920,286

(22) Filed: Oct. 22, 2015

Related U.S. Application Data

(60) Provisional application No. 62/068,124, filed on Oct. 24, 2014.

(51) Int. Cl.
*G09F 7/00* (2006.01)
*E01F 9/012* (2006.01)

(52) U.S. Cl.
CPC ..... *E01F 9/0122* (2013.01); *G09F 7/00* (2013.01)

(58) Field of Classification Search
CPC ..... G09F 7/00; G09F 15/0025; E01F 9/0122; E01F 9/014; E01F 9/0175; E01F 9/0118; E01F 13/02
USPC ..... 40/606.03; 116/63 C, 63 P
See application file for complete search history.

(56) References Cited

U.S. PATENT DOCUMENTS 3,707,320 A 12/1972 Brynes
4,197,807 A * 4/1980 Campbell ..... E01F 9/0122 116/63 P
5,287,822 A 2/1994 Anderson
5,305,705 A * 4/1994 Gagliano ..... E01F 9/0122 116/63 P
D348,412 S 7/1994 Hazelton
5,405,662 A 4/1995 Oberzan
5,488,792 A * 2/1996 Kwok ..... E01F 9/0122 116/63 C
5,566,638 A 10/1996 Rokosny
6,338,311 B1 1/2002 Ho
6,928,952 B2 * 8/2005 Garcia ..... E01F 9/0175 116/63 C
D514,463 S * 2/2006 Levine ..... D10/113.2
7,228,813 B2 * 6/2007 Flamingo ..... E01F 9/0122 116/63 C
7,677,831 B2 * 3/2010 Kulp ..... E01F 9/0122 116/63 C
7,811,026 B1 * 10/2010 Kulp ..... E01F 9/0122 116/63 C
2004/0237875 A1 * 12/2004 Garcia ..... E01F 9/0175 116/63 C
2005/0076822 A1 4/2005 Levine
2009/0260562 A1 * 10/2009 Folstad ..... B60Q 1/482 116/28 R
2014/0015692 A1 * 1/2014 Sun ..... E01F 9/0122 340/908

* cited by examiner

*Primary Examiner* — Shin Kim
(74) *Attorney, Agent, or Firm* — Robert C. Montgomery; Montgomery Patent & Design, LLLC

(57) ABSTRACT

A collapsible pylon includes a cover, an inner spring, and a stabilizing base. The cover is connected to the base and covers the spring. A placard, communicating the intent of the pylon, extends upward from the top of the pylon in a deployed configuration. The base includes a strap and corresponding fasteners to bind and retain the spring body, cover, and placard against the base in a collapsed and substantially flat position for storage. The collapsed pylon is then inserted into an attached case for storage.

19 Claims, 4 Drawing Sheets

COLLAPSIBLE PYLON

RELATED APPLICATIONS

The present invention is a continuation of, was first described in, and claims the benefit of U.S. Provisional Application No. 62/068,124, filed Oct. 24, 2014, the entire disclosures of which are incorporated herein by reference.

FIELD OF THE INVENTION

The present invention relates generally to a collapsible pylon having an informational placard extending from the top when deployed.

BACKGROUND OF THE INVENTION

Handicapped people confined to wheelchairs are faced with obstacles on a daily basis that most of us take for granted. Simple travel from place to place becomes a major undertaking that requires considerable effort. Fortunately, the public is becoming increasingly aware of the difficulties that these people face, and are responding in a positive manner. For example, legislation such as the Americans with Disabilities Act imposes responsibilities upon the public sector to make provisions to accommodate the physically handicapped so that they may gain access to, and take advantage of, the various goods and services available to others. Handicapped parking spots are one (1) of these provisions.

Unfortunately, many times such spaces are not wide enough for wheel chair ramp or mechanism access, forcing such users to park even farther away. Additionally, even if a space should be open to disembark the vehicle, it is often taken away by another parked vehicle when returning, leaving the wheelchair bound user stranded until it can be moved. Accordingly, there exists a need for a means by which the necessary space alongside a vehicle used with a wheelchair can be reserved for access. The use of the collapsible pylon provides a means to easily reserve space for wheelchair access along the side of a van or other vehicle in a manner which is not only quick, easy, and effective, but readily visible to other drivers as well.

SUMMARY OF THE INVENTION

It is therefore an object of the present invention to provide such a collapsible pylon capable of being positioned between a fully collapsed state and a fully disposed state. Such a pylon includes a base, a cover attached to the base and defining a storage cavity therein, a spring body attached to the base within the storage cavity at a first end and attached to an inner surface of a top panel of the cover at a second end, a placard disposed above the top panel of the cover and anchored to the base via a cord routed within the storage cavity, and a fastening strap affixed to the base for retaining the cover, the spring body, and the placard against the base when in the collapsed state.

Another object of the present invention is to provide a carrying case affixed to the base to retain the entire collapsed pylon therein, the carrying case has a flap and a flap fastener for retaining the collapsed pylon and a handle to assist in carrying the entire collapsed pylon.

Another object of the cover is to provide a body having a generally rectangular cross-section.

Yet another object of the cover is to provide at least one (1) reflective stripe located on an exterior surface thereof.

Another object of the base is to provide a section recessed area located on an upper surface within said storage cavity. The spring body fully resides within said recessed area when in the compressed state.

Yet another object of the base is to provide a drain located within the storage cavity.

Another object of the spring body is to provide a multi-coil compression spring having a rectangular helix.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
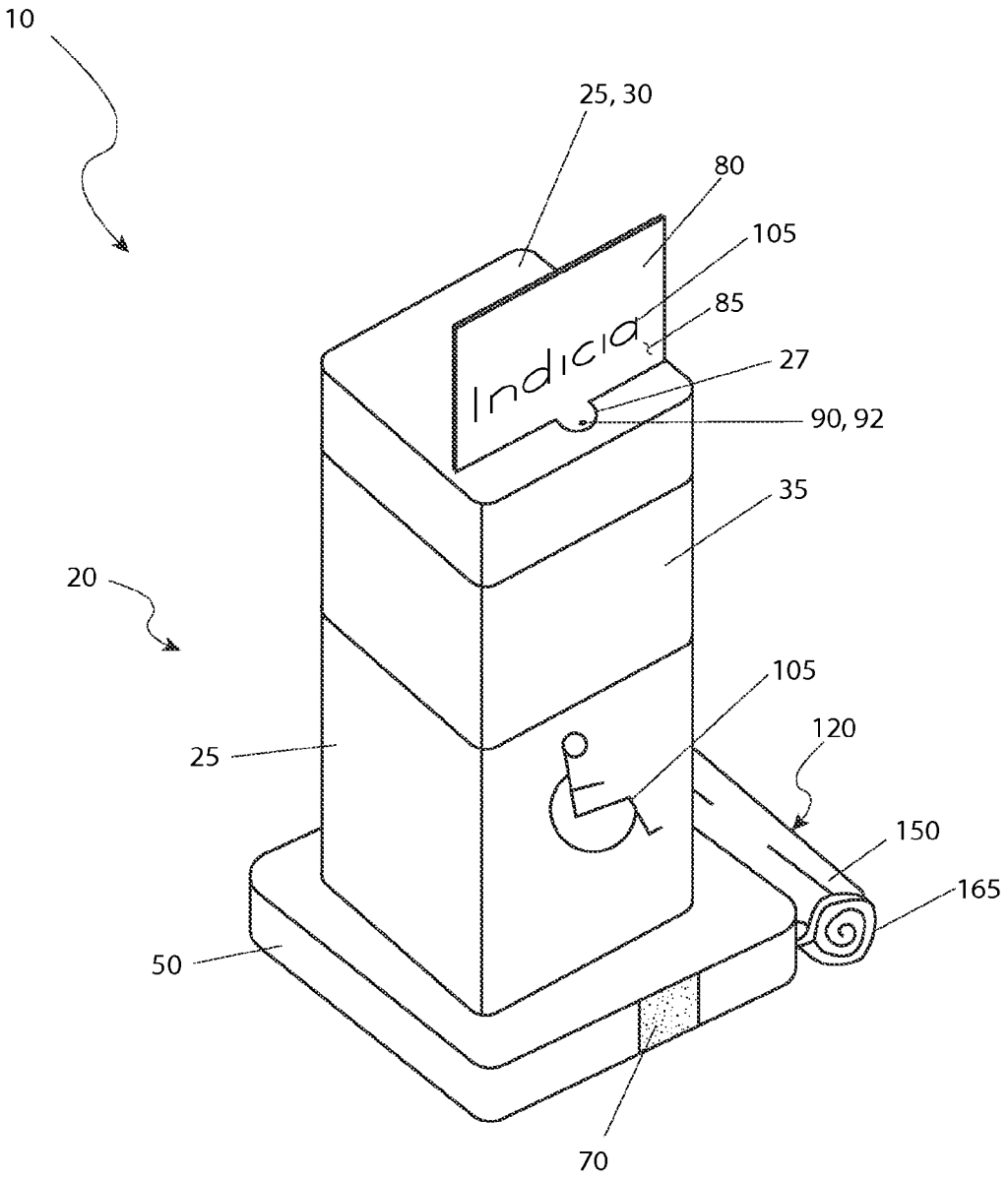
FIG. 1 is an isometric view of a collapsible pylon 10, in accordance with the preferred embodiment of the present invention.

10 collapsible pylon
20 spring enclosure assembly
25 cover
27 cover aperture
30 cap
35 stripe
40 spring
50 base
55 storage cavity
60 drain aperture
65 eyelet
70 first fastener
80 placard
85 placard face
90 placard aperture
92 placard tab
95 tension cord
105 indicia
110 strap
115 second fastener
120 carrying case
125 pouch
130 case exterior
135 case interior
140 cuff
145 cuff fastener
150 flap
155 flap fastener
160 handle
165 roll

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a collapsible pylon (herein referred to as the "device") 10, which preferably provides a means to selectively demark an access area for a vehicle utilized by a handicapped individual to indicate a requirement for an additional area to disembark from, and re-enter, the vehicle. While the preferred use of the device 10 is to function ostensibly to provide an access area for a vehicle, it is understood that such a device 10, with the stated capabilities, can find broader applications without limiting the scope of the invention.

Figure 2:
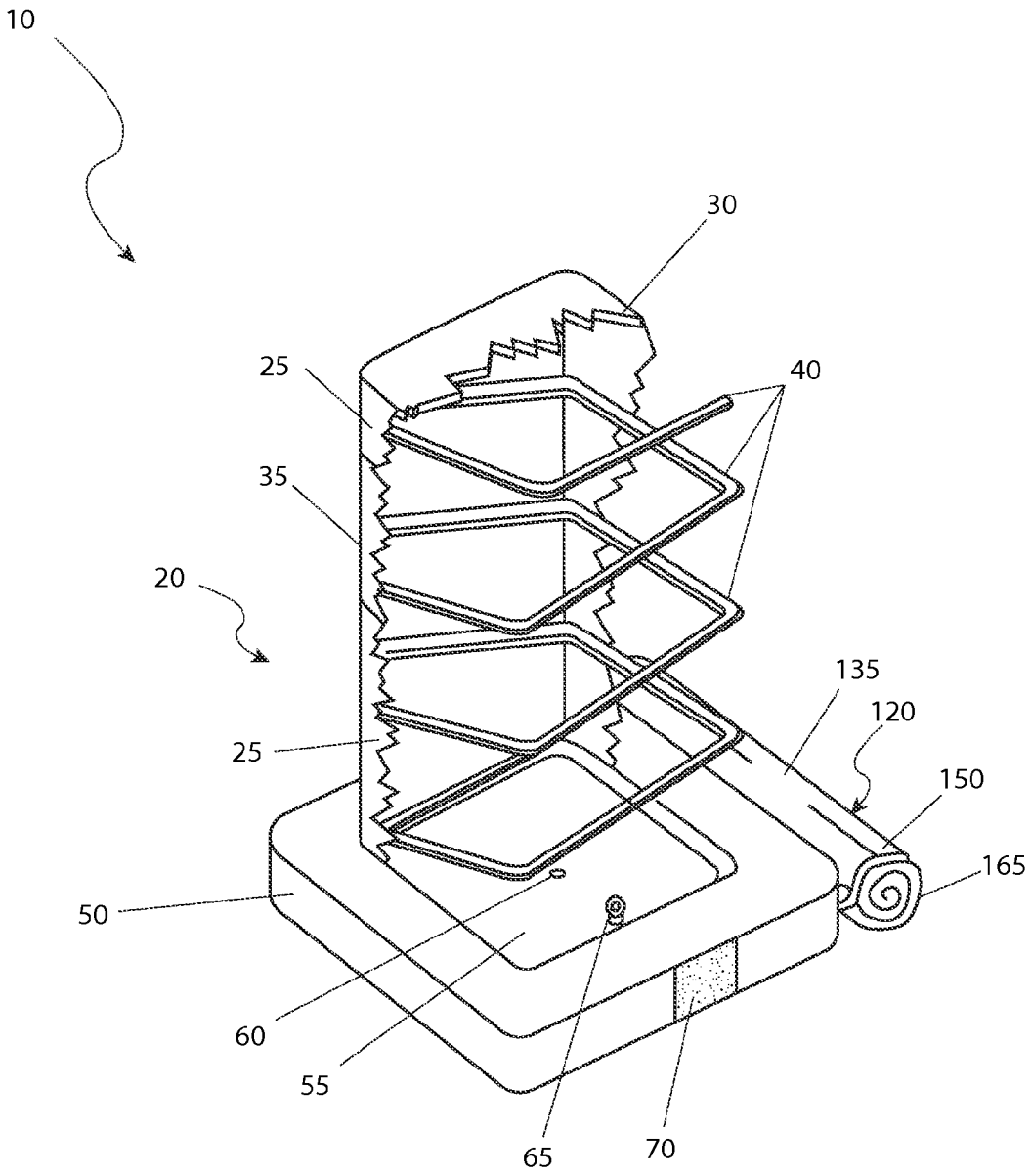
FIG. 2 is a breakaway view of the collapsible pylon 10 depicting an internal spring portion 40, in accordance with the preferred embodiment of the present invention.

Referring now to FIGS. 1 and 2, isometric and breakaway views of the device 10, according to the preferred embodiment of the present invention, are disclosed. The device 10 includes a spring enclosure assembly 20 with an attached placard 80, a stabilizing base 50, and a conveniently attached carrying case 120. The spring enclosure assembly 20 is configured to include a weather-resistant rectangularly shaped cover 25 composed of a synthetic textile, such as nylon, or the like. The cover 25 encompasses a correspondingly shaped multi-coil compression spring 40 having a rectangular helix shape. The spring 40 is formed with a rectangular cross-section as can be clearly seen in the breakaway view of FIG. 2. The cover 25 is illustrated here having a generally rectangular overall shape with sides and a top panel. The bottom edge portions of the cover 25 are in turn affixed to the base 50 in a perpendicular manner along side portions of a correspondingly shaped storage cavity portion 55 of the base 50. The storage cavity 55 is molded recessed area located centrally and formed into a top surface of the base 50. The cover 55 is affixed thereto the storage cavity 55 using adhesives, rivets, or an equivalent means. The cover 25 includes a planar cap portion 30 which extends horizontally across an inner top surface of the cover 25. The cap 30 is supported by the subjacent spring 40 within the spring enclosure assembly 20, thereby applying a force of the spring 40 evenly across the cap 30, thereby presenting the top of the cover 55 as a horizontal planar surface. The cap 30 is a square plate with rounded corners composed of a rigid thermoplastic material. The cover 25 and cap 30 provide a circular cover aperture 27 therethrough to enable attachment of a top-mounted placard 80 (also see FIG. 3).

The cover 25 is provided with at least one (1) reflective stripe 35 surrounding the spring enclosure assembly 20 to make the device 10 more noticeable when illuminated by an automotive headlight beam. It is envisioned that the cover 25 may also contain various indicia 105 consisting of specialized symbols and images typically indicative of handicapped and similar considerations.

Figure 3:
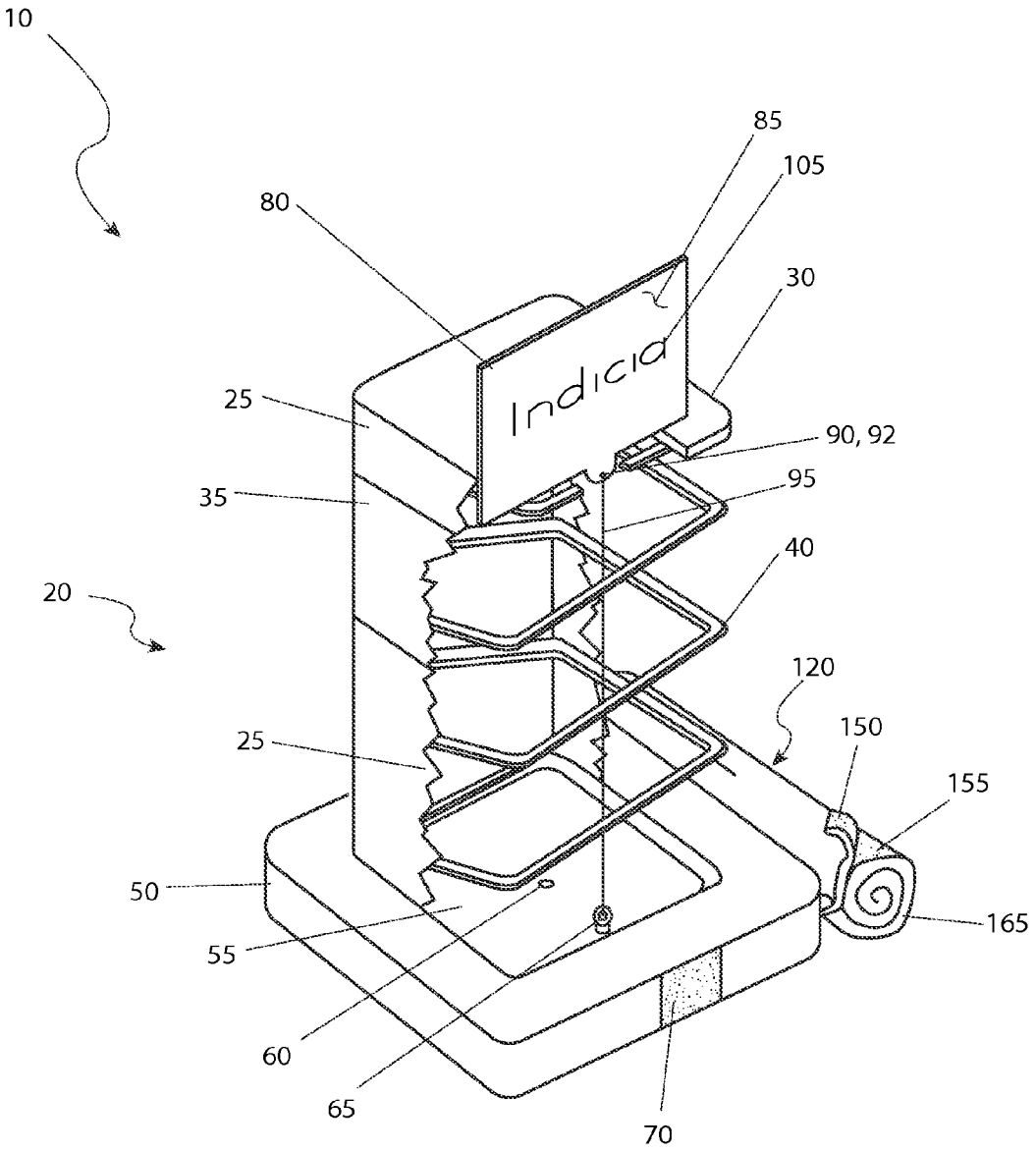
FIG. 3 is another breakaway view of the collapsible pylon 10 showing an erect placard portion 80, in accordance with the preferred embodiment of the present invention.

The base 50 is generally square and preferably made of a resilient weather-resistant material such as molded urethane, rubber, or other dense materials to aid in stabilizing the device 10 upon a surface. It is understood that other materials, such as other thermoplastics, wood, or metal, may also be utilized without limiting the scope of the device 10. It is also envisioned that additional weighting materials, such as high-density polymers, or a metal plate, may be embedded within the base 50 to provide a lower center of gravity and therefore improve stability. The base 50 may be provided with rounded corners and/or edges to improve the manufacturability of the device 10. The storage cavity 55 is disposed centrally within an upper portion of the base 50 as depicted in FIGS. 2 and 3. The storage cavity 55 is configured to be sized so as to adequately accommodate the spring enclosure assembly 20 and the placard 80 when in a compressed state (see FIG. 4). The spring 40 is mounted around the perimeter of the storage cavity 55, along with the cover 25, via a mechanical fit or equivalent means. A drain aperture 60 is disposed centrally within the storage cavity 55. The drain aperture 60 is configured to be a cylindrical channel between the storage cavity 55 and the bottom of the base 50 through which any accumulation of water, or other fluids, may be vented to the environment.

Figure 4:
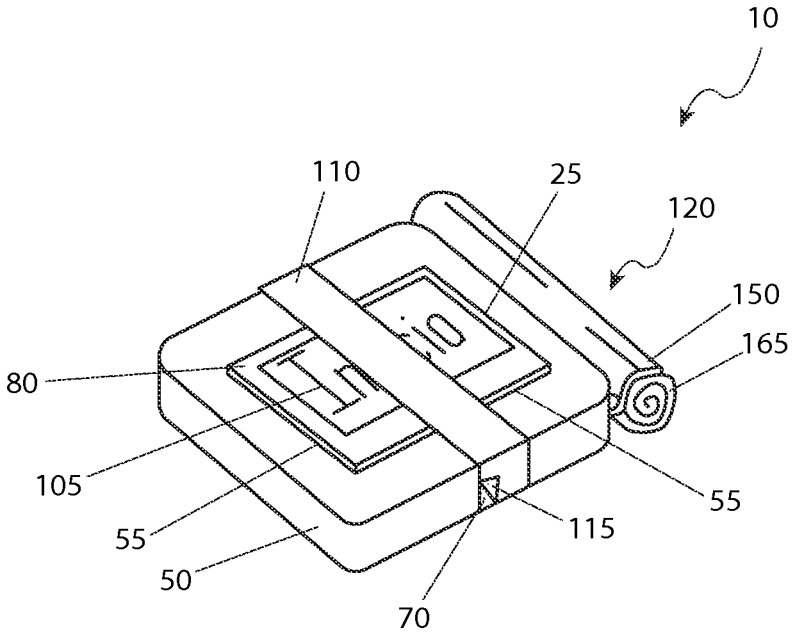
FIG. 4 is a perspective view of the collapsible pylon 10 configured as compressed and secured, in accordance with the preferred embodiment of the present invention; and, FIG. 5 is a perspective view of the collapsed pylon 10 being contained within a carrying case portion 120 ready for storage, in accordance with the preferred embodiment of the present invention.

The device 10 includes a means of compact compression and securement for purposes of storage via a strap 110 and corresponding fasteners 70, 115 located along outer surfaces of the base 50 (see FIG. 4).

Figure 5:
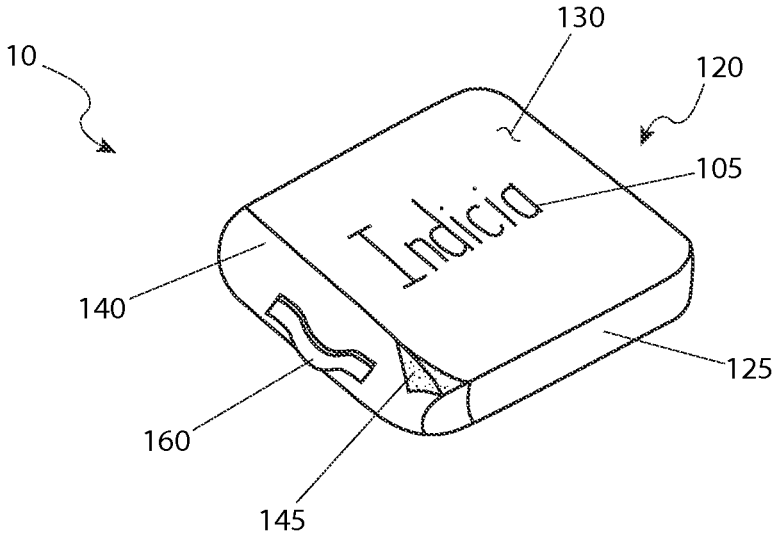

An attached carrying case 120 configured to be a pouch 125 is to be made of a weather-resistant synthetic textile such as nylon or the like, and is attached to a side edge of the base 50 using adhesives, rivets, or equivalent means (see FIGS. 4 and 5).

Referring now to FIG. 3, a breakaway view of the placard portion 80 of the device 10, according to the preferred embodiment of the present invention, is disclosed. The placard 80 is a rigid rectangular thermoplastic panel configured to project perpendicularly upward from the planar cap 30. The placard 80 includes an integral and downwardly protruding placard tab 92 formed intermediately along a lower edge portion and having a centrally located placard aperture 90. The placard tab 92 is disposed within the aforementioned cover aperture 27 which extends completely through the top of the cover 55 and the cap 30. A correspondingly positioned eyelet 65 is anchored to the bottom surface of the storage cavity 55 in vertical alignment with the placard tab 92. An elastic tension cord 95 extends between, and is affixed to, the eyelet 65 and the placard aperture portion 90 of the placard tab 92. When the spring enclosure assembly 20 is collapsed for storage, as demonstrated in FIG. 4, the tension cord 95 is in a relaxed state and the placard 80 freely rotates so as to lie parallel upon the cover 25. However, when the spring enclosure assembly 20 is fully extended via the spring 40, the tension cord 95 pulls taut upon the placard tab 92 and the placard 80 is forced to stand erect upon the top surface of the cover 25. The placard 80 is provided with opposing placard faces 85 which are envisioned to bear indicia 105 indicative of the purpose of the device 10.

To place the device 10 in use, the spring enclosure assembly 20 and base 50 portions in their collapsed and bound states are removed from the carrying case 120 by turning the case interior 135 inside out so as to peel the carrying case 120 from the compressed assembly. A flap 150 is thereby exposed which normally resides within the pouch 125. The pouch 125 is then formed into a roll 165 by joining the flap 150 to the corresponding flap fastener 155. The flap 150 and flap fastener 155 portion are envisioned to be complimentary pieces of a hook-and-loop fastener, such as VELCRO®, and are engaged to encompass the spring enclosure assembly 20 and the base 50 portions (also see FIGS. 4 and 5).

Referring now to FIGS. 4 and 5, perspective views depicting the device 10 in a compact secured state, and within a carrying case 120, respectively, according to the preferred embodiment of the present invention, are disclosed. A first fastener portion 70 is affixed thereto a side surface of the base 50 using adhesives or equivalent method, being the hooks portion of a hook-and-loop fastener, such as VELCRO®, and is disposed along at least one (1) side edge of the base 50. A strap 110, composed of the same constituent material as the cover 25, is attached to the base 50 at an opposite side edge, either by a fixed means, such as with an adhesive material, or a mechanical fastener, or by means of a second fastener 115 comprised of the hooks portion of a hook-and-loop fastener. The strap 110 is intended to retain the compressed spring enclosure assembly 20 within the storage cavity 55 of the base 50 when not in use as illustrated in FIG. 4. A second fastener 115 is disposed on at least one (1) end of the strap 110 for removable attachment of the strap 110 to the first fastener 70, thereby allowing release of the spring enclosure assembly 20 for use.

Compact storage of the device 10 is obtained by inserting the compressed spring enclosure assembly 20, as portrayed in FIG. 4, within the pouch portion 125 of the carrying case 120 by turning the case interior 135 over the compressed spring enclosure assembly 20, thereby revealing the case exterior 130. In order to accomplish this procedure the flap fastener 155, as previously described in FIG. 3, is disengaged and the pouch 125 is allowed to unroll to a flat arrangement. The pouch 125 is then inserted onto the compressed spring enclosure assembly 20 until wholly within the pouch 125. A cuff 140, configured to be an overlapping extension of the pouch 125, is folded over the open end of the pouch 125 and secured with a correspondingly positioned cuff fastener 145. The cuff fastener 145, in the preferred embodiment, is composed of the complimentary pieces of a hook-and-loop fastener, such as VELCRO®. A handle 160, preferably generally "U"-shaped, is sewn to, or otherwise attached to the cuff portion 140 of the pouch 125 to more easily facilitate manual transportation of the device 10. It is envisioned that additional indicia 105 which may further indicate the contents of the pouch 125 be disposed on the case exterior 130.

It is envisioned that other styles and configurations of the present invention can be easily incorporated into the teachings of the present invention, and only one particular configuration shall be shown and described for purposes of clarity and disclosure and not by way of limitation of scope.

In accordance with the invention, the illustrated embodiment can be utilized by an enabled individual in a simple and straightforward manner with little or no training. After initial purchase or acquisition of the device 10, it would be in all likelihood be arranged as indicated in FIG. 5 with a need to be set up for utilization as depicted in FIG. 1.

The method of installing and utilizing the device 10 may be achieved by performing the following steps: acquiring a model of the device 10; opening the cuff 140 by disengaging the cuff fastener 145; peeling the pouch 125 away from the base 50 and compressed spring enclosure assembly 20 portions, thereby reversing the pouch 125 to reveal the flap 150; securing the pouch 125 in the form of a roll 165 by attaching the flap 150 and flap fastener 155 portions; removing the strap 110 from the base 50 by detaching the first fastener 70 from the second fastener 115, being careful to coincidentally apply pressure to the placard 80 to avoid unexpected deployment of the spring enclosure assembly 20; permitting the spring 40 and spring enclosure assembly 20 to expand by slowly reducing pressure upon the placard 80; allowing the internal tension cord 95 to become taut and applying a downward tension upon the placard tab 92, causing the placard 80 to become erect; placing the device 10 in the appropriate location to selectively demark an area; and, benefiting from a compact and portable means to selectively demark an access area for a vehicle, afforded a user of the present invention 10.

The method of collapsing and preparing the device 10 for storage may be achieved by performing the following steps: pivoting the placard 80 to a parallel position upon the cover 25; collapsing the spring 40 within the spring enclosure assembly 20 by pressing downwardly upon the placard 80 until the spring enclosure assembly 20 is completely within the storage cavity 55; fastening the strap 110 securely to opposing sides of the base 50 by attaching respective first 70 and second 115 fastener portions to each other; releasing the flap 150 from the flap fastener 155; unrolling the pouch 125; reversing the pouch 125 so as to encompass the base 50 and spring enclosure assembly 20 portions; securing the pouch 125 in a closed state upon the base 50 and spring enclosure assembly 20 by fastening the cuff fastener 145 to the cuff 140; and, storing the device 10 until needed again.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A collapsible pylon, comprising:

a base;

a cover, having a lower perimeter edge affixed to an upper surface of said base, defining a storage cavity therein;

a top panel supported on an upper perimeter edge of said cover;

a spring body, having a lower end attached to an upper surface of said base within said storage cavity and an upper end attached to an inner surface of said top panel; and, a placard disposed above said top panel, having a tab anchored via a cord to said base upper surface within said storage cavity;

wherein said cover, said spring body, and said placard is selectively positioned between a deployed state and a compressed state; and, wherein said storage cavity retains said spring body therewithin when in said compressed state.

2. The collapsible pylon of claim 1, wherein said cover further comprises a generally rectangular cross-section.

3. The collapsible pylon of claim 1, further comprising a recessed area located on said base upper surface within said storage cavity;

wherein said spring body fully resides within said recessed area when in said compressed state.

4. The collapsible pylon of claim 1, wherein said spring body further comprises a multi-coil compression spring having a rectangular helix.

5. The collapsible pylon of claim 1, further comprising at least one reflective stripe located on said cover.

6. The collapsible pylon of claim 1, further comprising a drain located within said storage cavity of said base.

7. A collapsible pylon, comprising:

a base;

a cover, having a lower perimeter edge affixed to an upper surface of said base, defining a storage cavity therein;

a top panel supported on an upper perimeter edge of said cover;

a spring body, having a lower end attached to an upper surface of said base within said storage cavity and an upper end attached to an inner surface of said top panel;

a placard disposed above said top panel, having a tab anchored via a cord to said base upper surface within said storage cavity; and, a fastening strap attached to said base;

wherein said cover, said spring body, and said placard is selectively positioned between a deployed state and a compressed state;

wherein said storage cavity retains said spring body therewithin when in said compressed state; and, wherein said fastening strap has a securing means for securing said cover, said spring body, and said placard in said compressed state.

8. The collapsible pylon of claim 7, wherein said cover further comprises a generally rectangular cross-section.

9. The collapsible pylon of claim 7, further comprising a recessed area located on said base upper surface within said storage cavity;

wherein said spring body fully resides within said recessed area when in said compressed state.

10. The collapsible pylon of claim 7, wherein said spring body further comprises a multi-coil compression spring having a rectangular helix.

11. The collapsible pylon of claim 7, further comprising at least one reflective stripe located on said cover.

12. The collapsible pylon of claim 7, further comprising a drain located within said storage cavity of said base.

13. A collapsible pylon, comprising:

a base;

a cover, having a lower perimeter edge affixed to an upper surface of said base, defining a storage cavity therein;

a top panel supported on an upper perimeter edge of said cover;

a spring body, having a lower end attached to an upper surface of said base within said storage cavity and an upper end attached to an inner surface of said top panel;

a placard disposed above said top panel, having a tab anchored via a cord to said base upper surface within said storage cavity;

a fastening strap attached to a first side of said base; and, a carrying case affixed along an entire second side of said base wherein said cover, said spring body, and said placard is selectively positioned between a deployed state and a compressed state;

wherein said storage cavity retains said spring body therewithin when in said compressed state;

wherein said fastening strap has a securing means for securing said cover, said spring body, and said placard in said compressed state; and, wherein said carrying case retains said collapsible pylon therewithin when in said collapsible state.

14. The collapsible pylon of claim 13, wherein said cover further comprises a generally rectangular cross-section.

15. The collapsible pylon of claim 13, further comprising a recessed area located on said base upper surface within said storage cavity;

wherein said spring body fully resides within said recessed area when in said compressed state.

16. The collapsible pylon of claim 13, wherein said spring body further comprises a multi-coil compression spring having a rectangular helix.

17. The collapsible pylon of claim 13, further comprising at least one reflective stripe located on said cover.

18. The collapsible pylon of claim 13, further comprising a drain located within said storage cavity of said base.

19. The collapsible pylon of claim 13, wherein said carrying case further comprises:

a flap;

a flap fastening means for retaining said collapsible pylon within said carrying case; and, a handle affixed to an exterior surface of said carrying case.

* * * * *